United States Patent [19]

Helms

[11] 4,211,336

[45] Jul. 8, 1980

[54] CONTAINER CLOSURE

[75] Inventor: Charles R. Helms, Collegeville, Pa.

[73] Assignee: Container Corporation of America, Chicago, Ill.

[21] Appl. No.: 66,577

[22] Filed: Aug. 15, 1979

[51] Int. Cl.[2] ..... B65D 41/32

[52] U.S. Cl. ..... 220/270; 220/260; 229/43; 220/359

[58] Field of Search ..... 220/260, 266, 270, 359, 220/276; 229/43

[56] References Cited

U.S. PATENT DOCUMENTS

| | | | |
|---|---|---|---|
| 3,184,096 | 5/1965 | Cheeley | 220/260 |
| 4,155,481 | 5/1979 | Takahashi et al. | 220/270 |

*Primary Examiner*—George T. Hall

*Attorney, Agent, or Firm*—Carpenter & Ostis

[57] ABSTRACT

A closure secured to the end of a container body has a rim made of resinous material secured to the container body. A closure panel, made of fibrous material is molded to the rim. A tear strip is provided for easy opening of the container.

4 Claims, 5 Drawing Figures

CONTAINER CLOSURE

BACKGROUND OF THE INVENTION

This invention relates to the part of the container art wherein a resinous material is adhered to a fibrous material, such as paperboard or the like, for forming a composite container structure.

Heretofore closures of the easy opening kind have been formed from thin gauge easily rupturable material such as aluminum, but in the interests of economy it is desirable to have the container closure also made in part from paperboard molded to resinous material and in turn secured to the end of the container body thereby providing a structure for easy opening of the paperboard portion of the closure.

SUMMARY OF THE INVENTION

The structure of this invention relates to composite container closures of the kind having a central panel formed of fibreboard adhered to a sturcture made of a resinous material and having an annular rim secured to the wall of a container along the end thereof. The fibreboard central panel cooperates with a pull tab and tear strip formed in the resinous material of the rim structure, the tear strip having the function of tearing along a selected line of weakness in both the resinous rim structure and in the fibreboard panel.

In the embodiment illustrated and described herein, the container body is shown as having a cylindrical configuration. It is within the purview of the present invention that the body may be circular, oval or of any other suitable shape.

THE DRAWINGS

Figure 2:
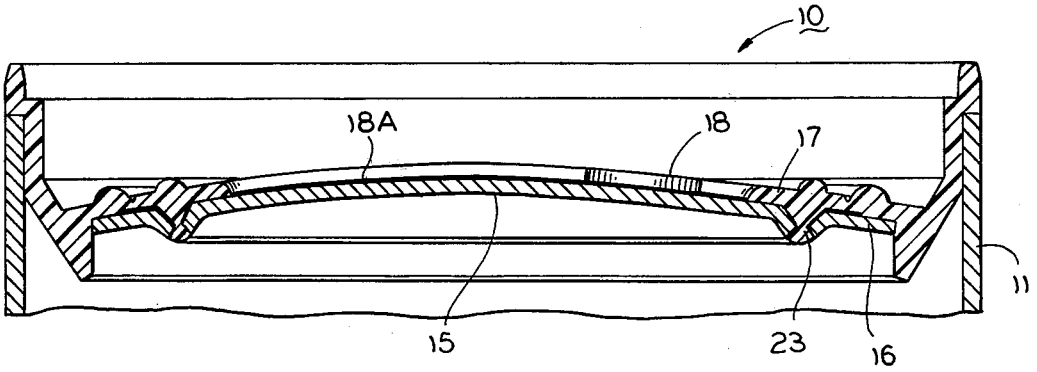
FIG. 2 is a sectional view on an enlarged scale taken generally along the line 2—2 of FIG. 1.

The improved container closure according to the present invention is denoted by the reference numeral 10 and is designed to close the open end of a container body 11. The body 11 is shown as being made of fibreboard and is of cylindrical shape, but it is within the scope of the invention that its transverse cross section, for example, may be rectangular or elliptical.

The closure 10 includes a rim 13 arranged to be secured to an open end 12 of the container body 11, and is formed of a resinous material of any desired kind which can be adhered to the body 11 in any suitable manner well known in the art. Except for the further details of the closure 10, the form of the rim 13 shown herein is not limitative of the invention, and it may adopt other variant forms.

The rim 13 includes a depressed rim portion the underside of which is adhered to a closure panel 14 which includes a central panel element 15 and a central panel rim element 16. The closure panel 15 is preferably formed from fracturable sheet material, such as paperboard.

Figure 3:
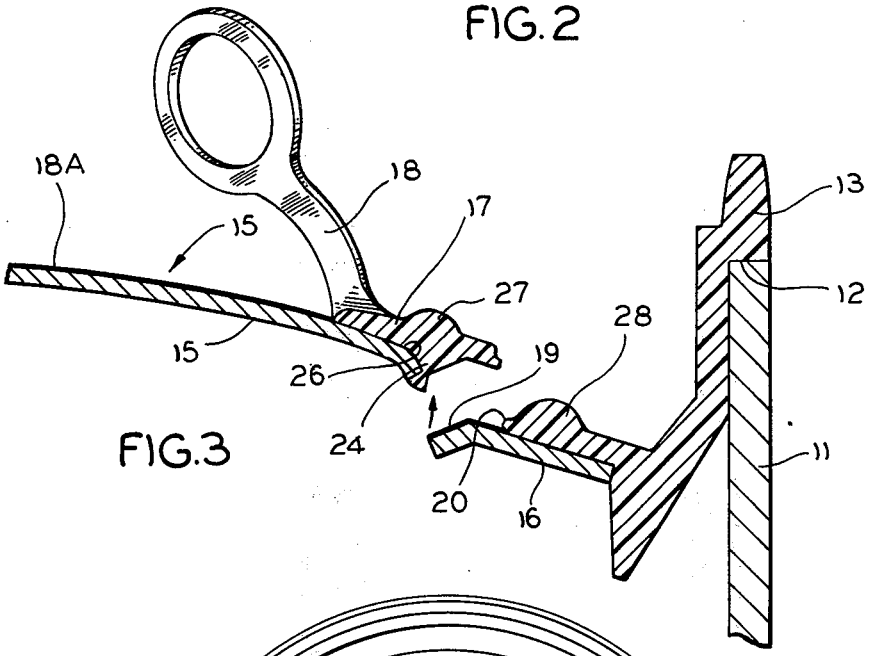
FIG. 3 is a sectional view on an enlarged scale showing the operation of the pull tab and the tear strip.
Figure 1:
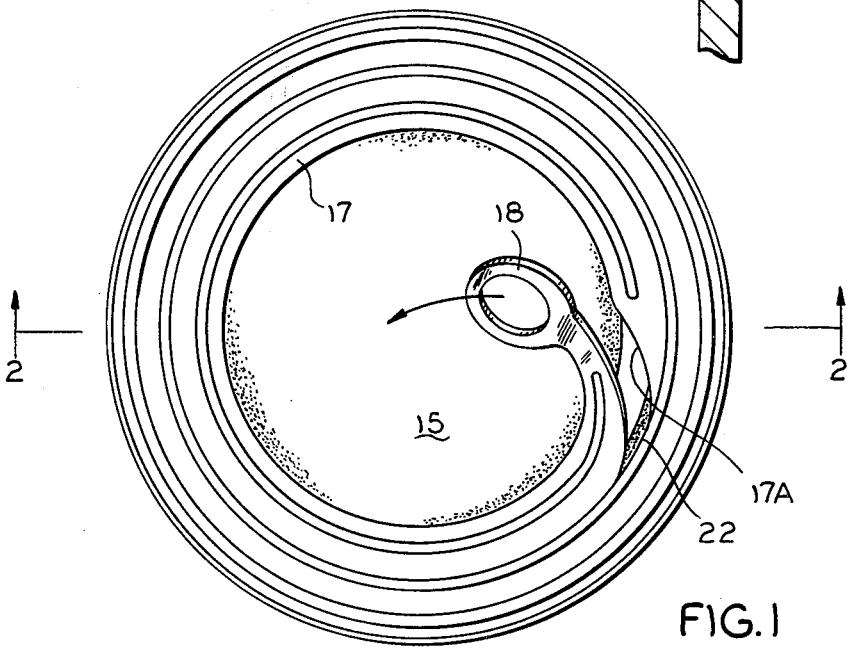
FIG. 1 is a plan view of a container closure according to the present invention showing a pull tab and a related tear strip positioned for operation.
Figure 4:
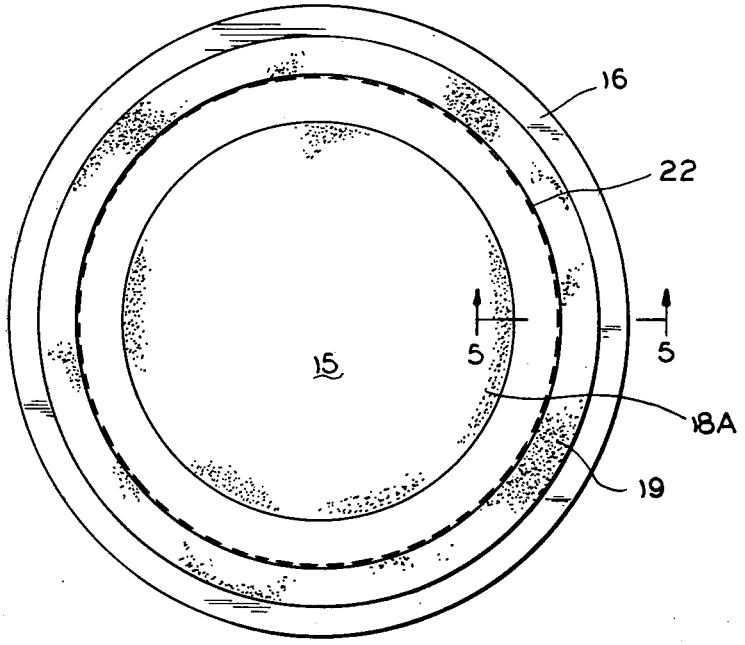
FIG. 4 is a plan view showing a disc of paperboard employed in the construction of the container closure.

The rim 13 is formed with a tear strip 17 overlying the closure panel 14 and being circular in plan view, as seen in FIGS. 1 and 4. It is continuous except for a line of tear 17A, seen in FIG. 1, adjacent an integral ring pull tab 18. The tear strip 17 is adhered to the central panel element 15, but is free from attachment to the central panel rim element 16 by reason of a coating 19 atop said element. The pull tab 18 is free from attachment to the central panel element 15 by reason of a coating 18A atop of said element, as been seen in FIG. 3.

The tear strip 17 is enabled to be separated as desired from the rim 13 by a circular line of weakness 20 connecting the tear strip 17 to the rim 13.

Figure 5:
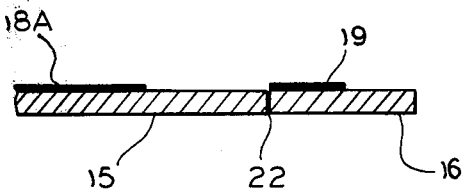
FIG. 5 is a sectional view on an enlarged scale taken generally along the line 5—5 of FIG. 4.

The rim 13, formed of resinous material, is molded to adhere selectively to the closure panel. In the molding of the latter to the rim 13, which is commonly done in an injection molding process, the closure panel 14 with heretofore described elements 15 and 16, best seen in FIGS. 4 and 5, is placed into the mold prior to the injection of the molding material. The closure has a circular line of weakness illustrated by a line of perforations 22 adjacent the non-adhering coating 19 which lies outward of said perforation line 22.

The mold, not shown, is so configured that after placement of the closure panel, the injection of the molding material causes a V-groove 23 to be formed at the perforation line 22. A rib 24 of resinous material protrudes into the groove 23. One inside surface 26 of the tear strip 17 is adhered to the central panel element 15 inwardly of the perforation line 22, while the other inside surface 29 of the tear strip 17 remains unattached to the central panel rim element 16 by virtue of the non-adhering characteristics of the coating 19 which lies outwardly of the perforation line 22.

In order to give strength to the tear strip 17, it is provided with a reinforcing rib 27 surmounting the rib 24. Likewise, the rim 13, adjacent the fracturable line of weakness 20, is provided with a stiffening rim 28 overlying the central panel rim element 16 adhered to the underside of the rim 13.

When the pull tab 18 is lifted and the line of tear 17A is separated, continued movement of the pull tab 18 and the tear strip 17 causes a separation of the closure panel 14 into a rim portion adhered to the underside of the rim structure and the central panel portion 15 adhered to the tear strip 17.

I claim:

1. A container closure for securement along a rim of a container body at an end thereof, said closure being characterized by a closure panel extending between said rim and closing an open end of said body, said closure panel comprising:

(a) a central panel element having a tear strip formed thereon extending along the periphery of said element;

(b) a fracturable line of weakness in said element disposed between said tear strip and said rim;

(c) said tear strip being formed of resinous material and having a line of protrusions extending through said central panel element spaced from the periphery thereof to separate said element into a central portion adhered to said tear strip and a rim portion adhered to said rim.

2. A container according to claim 1, wherein said closure panel and said rim are molded together and wherein said line of protrusions of said resinous material forms a V-groove in said closure panel, one side of said groove being adhered to said central panel element and the protrusions of said tear strip, and the other side being unadhered to said protrusion.

3. A container according to claim 1, wherein said tear strip is provided with a pull tab free from attachment to said central panel element.

4. A container according to claim 2, wherein said central portion and said rim portion are connected to each other along a perforated line with said resinous material protruding through said line.

* * * * *